US007466079B2

(12) United States Patent
Lee et al.

(10) Patent No.: US 7,466,079 B2
(45) Date of Patent: Dec. 16, 2008

(54) PLASMA DISPLAY PANEL AND METHOD FOR MANUFACTURING THE SAME

(75) Inventors: Sang Kook Lee, Gumi-si (KR); Joong Kyun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 427 days.

(21) Appl. No.: 10/942,053

(22) Filed: Sep. 16, 2004

(65) Prior Publication Data

US 2005/0062419 A1 Mar. 24, 2005

(30) Foreign Application Priority Data

Sep. 18, 2003 (KR) ..... 10-2003-0064811
Sep. 10, 2004 (KR) ..... 10-2004-0072647

(51) Int. Cl.
*H01J 17/49* (2006.01)

(52) U.S. Cl. ..... 313/587; 313/582; 313/586; 445/24

(58) Field of Classification Search ..... 313/582, 313/587, 586; 445/24
See application file for complete search history.

(56) References Cited

U.S. PATENT DOCUMENTS

| | | | | |
|---|---|---|---|---|
| 2001/0015621 | A1* | 8/2001 | Oniki | 313/582 |
| 2002/0036466 | A1* | 3/2002 | Tanaka et al. | 313/586 |
| 2003/0030377 | A1 | 2/2003 | Hirano et al. | 313/587 |

FOREIGN PATENT DOCUMENTS

| | | | |
|---|---|---|---|
| CN | 1327253 | | 12/2001 |
| EP | 1 367 621 | A1 | 12/2003 |
| EP | 1 548 791 | A1 | 6/2005 |
| JP | 2000-067759 | | 3/2000 |
| JP | 2001-307647 | | 11/2001 |
| JP | 2002358897 | A * | 12/2002 |
| WO | WO 02/063651 | A1 | 5/2002 |

OTHER PUBLICATIONS

European Search Report dated May 31, 2006.
Chinese Office Action dated Apr. 12, 2006.
European Office Action dated Mar. 19, 2008.
J.P.Bocuf, "Plasma display panels: physics, recent developments and key issues," J. Phys. D: Appl. Phys. 36 (2003) R53-R79, Feb. 26, 2003.

* cited by examiner

*Primary Examiner*—Nimeshkumar D. Patel
*Assistant Examiner*—Anthony T Perry
(74) *Attorney, Agent, or Firm*—Ked & Associates, LLP

(57) ABSTRACT

The present invention relates to a plasma display panel and method for manufacturing the same in which electron discharge characteristic is improved and a voltage margin can be secured. According to a first embodiment of the present invention, a plasma display panel including a plurality of a pair of display electrodes formed and arranged parallely on an upper plate, a plurality of address electrodes formed on a lower plate and arranged to be crossed to the display electrodes, a barrier rib defined a discharge space on the lower plate, and fluorescent body formed between the barrier ribs, includes further: a number of discharge cells having the discharge space; and an alkali metal layer formed in the discharge cells for supplying electrons to the discharge space.

26 Claims, 5 Drawing Sheets

Fig. 2

| Classification | Electron emission mechanism | Jitter characteristic | Amount of charge |
|---|---|---|---|
| Protection film (MgO) | Secondary electron emission | 1.2μs or more | Insufficient |
| Alkali metal layer | Spontaneous emission | 0.5μs or less | sufficient |

PLASMA DISPLAY PANEL AND METHOD FOR MANUFACTURING THE SAME

CROSS-REFERENCE TO RELATED APPLICATIONS

This Nonprovisional application claims priority under 35 U.S.C. § 119(a) on patent application No. 10-2003-0064811 filed in Korea on Sep. 18, 2003 and Application No. 10-2004-0072647 filed in Korea on Sep. 08, 2004, the entire contents of which are hereby incorporated by reference.

1. Field of the Invention

The present invention relates to a plasma display panel, and more particularly, to a plasma display panel and method for manufacturing the same in which electron discharge characteristic is improved and a voltage margin can be secured.

2. Background of the Related Art

A plasma display panel (hereinafter, referred to as a 'PDP') is adapted to display an image including characters or graphics by light-emitting phosphors with ultraviolet of 147 nm generated during the discharge of an inert mixed gas such as He+Xe, Ne+Xe or He+Ne+Xe., This PDP can be easily made thin and large, and it can provide greatly increased image quality with the recent development of the relevant technology. Particularly, a three-electrode AC surface discharge type PDP has advantages of lower driving voltage and longer product lifespan as a wall charge is accumulated on a surface in discharging and electrodes are protected from sputtering caused by discharging.

In a discharge cell of a PDP, if an opposite discharge occurs between data electrode X and sustain electrode Y, a gas injected into discharge spaces by the opposite discharge is ionized to become a plasma state where a positive ion and electrons coexist. In the plasma state, as phosphors are excited/light-emitted by ultraviolet rays emitted from particles excited by collision, a visible ray is generated. Thereafter, a surface discharge between the pair of the sustain electrodes enables plasma particles existing in the discharge spaces to sputter the surface of a dielectric film with accelerated kinetic energy. Due to this, the dielectric film is damaged. In order to prevent such damage, a protection film is formed on the dielectric film. The protection film is typically formed using magnesium oxide (MgO).

However, magnesium oxide (MgO) constituting the protection film has a strong covalent bond structure, and it is thus easily combined with an impurity containing moisture and carbon monoxide (CO). Accordingly, fine cracks are created on the surface of the protection film due to shock of the plasma particles. Thus, there are problems in that the lifespan of the protection film is shortened and a probability of emitting secondary electrons generated from the protection film upon opposite discharge is lowered.

Furthermore, recently, in order to enhance discharge efficiency, the ratio of a discharge gas Xe is increased while the ratio of a discharge gas Ne is lowered. That is, in case of an inert mixed gas such as Ne+Xe that is injected into a conventional PDP, the amount of Ne is about 95% and the amount of Xe is about 5%. On the contrary, today, the amount of Xe injected into a PDP is about 14%.

As described above, since the amount of Xe is significantly higher than that of Ne as compared with the prior art, a path of electrons is limited if the amount of Xe increases. It is thus required that a voltage for generating a discharge be increased. In other words, if the amount of Xe increases, breakdown occurs between the scan electrodes Y and the sustain electrodes Z, and a sustain voltage is increased.

Moreover, even in driving a PDP, a cooling effect of electrons is increased due to an increase in the amount of Xe. That is, since the amount of Xe is relatively significantly higher than that of Ne, movement of electrons becomes difficult accordingly. Thus, there is a problem in that time delay where discharge ignition is delayed occurs.

SUMMARY OF THE INVENTION

Accordingly, the present invention has been made in view of the above problems, and it is an object of the present invention to provide a plasma display panel in which an emission characteristic of electrons is improved and a voltage margin can be secured.

According to a first embodiment of the present invention, a plasma display panel including a plurality of a pair of display electrodes formed and arranged parallely on an upper plate, a plurality of address electrodes formed on a lower plate and arranged to be crossed to the display electrodes, a barrier rib defined a discharge space on the lower plate, and fluorescent body formed between the barrier ribs, includes further: a number of discharge cells having the discharge space; and an alkali metal layer formed in the discharge cells for supplying electrons to the discharge space.

According to a first embodiment of the present invention, a method for manufacturing a plasma display panel including a plurality of a pair of display electrodes formed and arranged parallely on an upper plate, a plurality of address electrodes formed on a lower plate and arranged to be crossed to the display electrodes, a barrier rib defined a discharge space on the lower plate, and fluorescent body formed between the barrier ribs, comprises the step of: forming a number of discharge cell having the discharge space; and forming an alkali metal layer in each of the discharge cells for supplying electrons to the discharge spaces.

According to a second embodiment of the present invention, a plasma display panel including a plurality of a pair of display electrodes formed and arranged parallely on an upper plate, a plurality of address electrodes formed on a lower plate and arranged to be crossed to the display electrodes, a barrier rib defined a discharge space on the lower plate, and fluorescent body formed between the barrier ribs, wherein the plasma display panel includes further: a number of discharge cells having the discharge space; and an alkali metal layer formed in each of the discharge cells for supplying electrons to the discharge spaces, and a concentration of Xe in the discharge space is 10% or more.

In the PDP and method for manufacturing the same according to the present invention, the alkali metal layer that supplies sufficient electrons to discharge cells is formed on the protection film. Accordingly, an increase in the sustain voltage, which is caused by relatively lowering the ratio of the discharge gas Ne while increasing the ratio of the discharge gas Xe in order to increase secondary electrons and discharge efficiency reduced due to defects on the protection film in the prior art, is compensated by sufficient electrons generated from the alkali metal. As a sustain voltage (Vs) is prevented from being increased as such, a voltage margin can be secured easily.

BRIEF DESCRIPTION OF THE DRAWINGS

Further objects and advantages of the invention can be more fully understood from the following detailed description taken in conjunction with the accompanying drawings in which:

FIG. 2 is a table showing comparison results of characteristics between an alkali metal layer and a protection film shown in FIG. 1;

DETAILED DESCRIPTION OF THE PREFERRED EMBODIMENT

Preferred embodiments of the present invention will be described in a more detailed manner with reference to the drawings.

First Embodiment

According to a first embodiment of the present invention, a plasma display panel including a plurality of a pair of display electrodes formed and arranged parallely on an upper plate, a plurality of address electrodes formed on a lower plate and arranged to be crossed to the display electrodes, a barrier rib defined a discharge space on the lower plate, and fluorescent body formed between the barrier ribs, includes further: a number of discharge cells having the discharge space; and an alkali metal layer formed in the discharge cells for supplying electrons to the discharge space.

Further, each of the discharge cells comprises a protection film, and the alkali metal layer is formed on the protection film.

Further, each of the discharge cells comprises an upper dielectric layer and a protection film, and the alkali metal layer is formed between the upper dielectric layer and the protection film.

Further, the alkali metal layer has a thickness of 5 Å to 1000 Å.

Further, the concentration of Xe in the discharge space is 10% or more.

Further, the alkali metal layer includes at least one selected from the group consisting of rubidium (Rb), potassium (K) and cesium (Cs).

Further, the alkali metal layer is formed on the lower plate.

According to a first embodiment of the present invention, A method for manufacturing a plasma display panel including a plurality of a pair of display electrodes formed and arranged parallely on an upper plate, a plurality of address electrodes formed on a lower plate and arranged to be crossed to the display electrodes, a barrier rib defined a discharge space on the lower plate, and fluorescent body formed between the barrier ribs, comprises the step of: forming a number of discharge cell having the discharge space; and forming an alkali metal layer in each of the discharge cells for supplying electrons to the discharge spaces.

Further, the method further comprises the step of forming a protection film in each of the discharge cells.

Further, the alkali metal layer is formed on the protection film.

Further, the method further comprises the steps of forming an upper dielectric layer in each of the discharge cells, and forming a protection film, wherein the alkali metal layer is formed between the upper dielectric layer and the protection film.

Further, the alkali metal layer includes at least one selected from the group consisting of rubidium (Rb), potassium (K) and cesium (Cs).

Further, the alkali metal layer has an embossing shape.

Further, the alkali metal layer has a thickness of 5 Å to 1000 Å.

Further, the alkali metal layer is formed on the lower plate.

Figure 1:
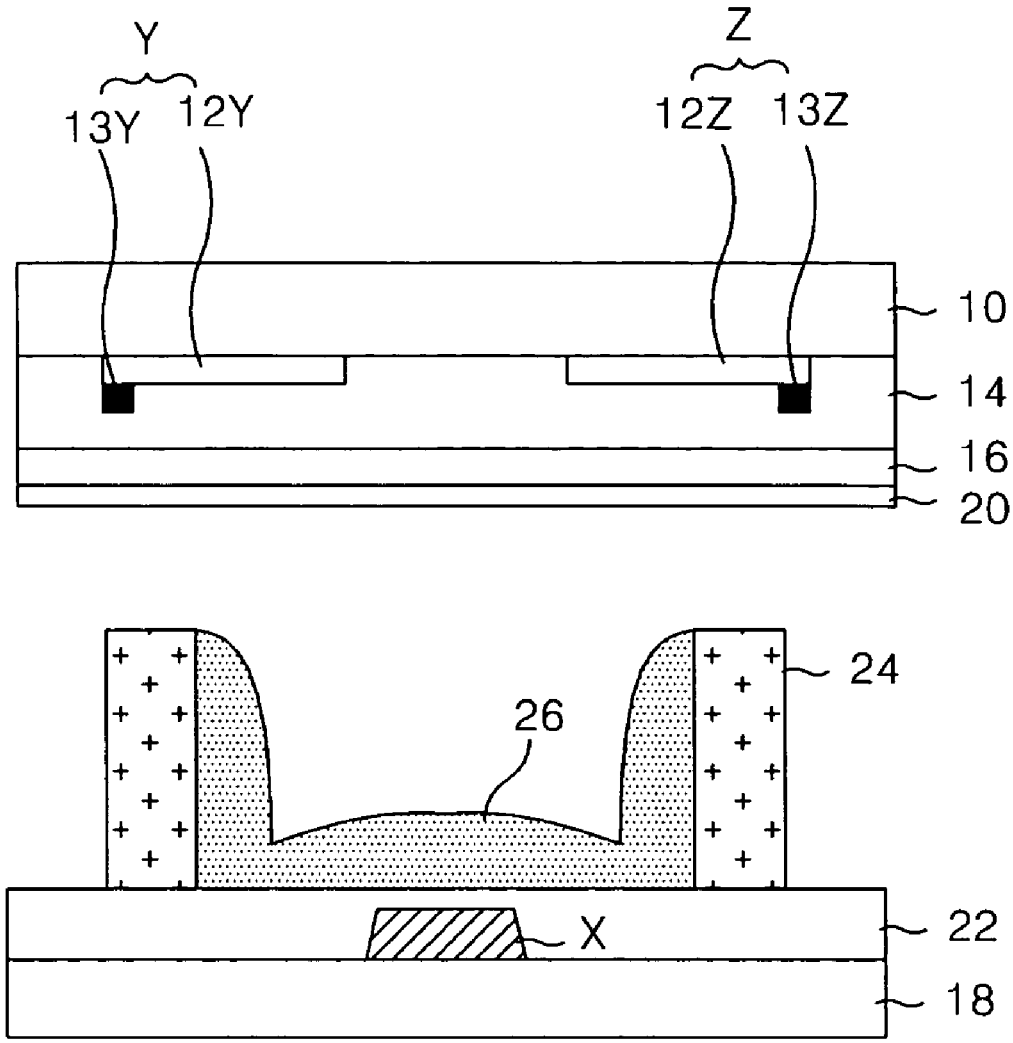
FIG. 1 is a cross-sectional view illustrating a plasma display panel according to a first embodiment of the present invention.

FIG. 1 is a cross-sectional view illustrating a plasma display panel according to a first embodiment of the present invention.

A discharge cell of the PDP shown in FIG. 1 includes a pair of sustain electrodes formed on an upper substrate 10, i.e., a scan electrode Y and a sustain electrode Z, and a data electrode X formed on a lower substrate 18.

The scan electrode Y of the pair of the sustain electrodes includes a transparent electrode 12Y, and a bus electrode 13Y that has a line width smaller than that of the transparent electrode 12Y and is formed at one edge of the transparent electrode. Meanwhile, the sustain electrode Z of the pair of the sustain electrodes includes a transparent electrode 12Z, and a bus electrode 13Z that has a line width smaller than that of the transparent electrode 12Z and is formed at one edge of the transparent electrode.

The transparent electrodes 12Y and 12Z are formed on the upper substrate 10 typically using indium tin oxide (ITO). The bus electrodes 13Y and 13Z are formed on the transparent electrodes 12Y and 12Z, respectively, using a metal such as chromium (Cr) so that they are overlapped with barrier ribs 24. The bus electrodes 13Y and 13Z serve to reduce a voltage drop caused by the transparent electrodes 12Y and 12Z having high resistance.

An upper dielectric layer 14, a protection film 16 and an alkali metal layer 20 are formed on the upper substrate 10 on which the pair of the sustain electrodes Y and Z is formed. A wall charge generated upon plasma discharge is accumulated on the upper dielectric layer 14. The protection film 16 serves to prevent the upper dielectric layer 14 from being damaged by sputtering generated upon the plasma discharge. In the above, the protection film 16 can be made of magnesium oxide (MgO).

The alkali metal layer 20 serves to increase an efficiency of emission of electrons. This will be described in detail as follows. Since alkali metals (1-group elements in the periodic table) have small ionization energy, they have their electrons lost easily and thus become stable positive ion since they satisfy octet rules. As such, since the alkali metals have strong properties that they lose electrons, sufficient electrons are provided to discharge cells and low-voltage driving of a PDP is made possible. That is, while alkali metals of the alkali metal layer 20 are ionized, sufficient electrons are emitted and discharge efficiency is thus improved. In the above, examples of the alkali metals may include rubidium (Rb), potassium (K), cesium (Cs) and the like.

At this time, it is preferred that the alkali metal layer 20 is formed to a thickness of 5 Å to 1000 Å If the thickness of the alkali metal layer 20 exceeds 1000 Å distortion of an electric field is generated within the cell, thus adversely affecting a discharge. In addition, there is a possibility that it would act as a contamination source by ion sputtering during a discharge.

The data electrode X is formed in the direction to intersect the scan electrode Y and the sustain electrode Z. A lower dielectric layer 22 for accumulating a wall charge is formed on the lower substrate 18 on which the data electrode X is formed. Barrier ribs 24 are formed on the lower dielectric layer 22. Phosphors 26 are coated on the lower dielectric layer 22 and the barrier ribs 24. The barrier ribs 24 are formed in parallel to the data electrode X and serve to prevent an ultraviolet ray and a visible ray generated by discharge from leaking to neighboring discharge cells. The phosphors 26 are excited by the ultraviolet ray generated at the time of a plasma discharge, thus generating one of red, green and blue visible rays. An inert gas for a gas discharge is injected into the discharge spaces formed between the upper/lower substrates 10 and 18 and the barrier ribs 24.

After the discharge cell constructed as above is selected by the opposite discharge between the data electrode X and the sustain electrode Y, a discharge sustains in the selected discharge cell through the surface discharge between the pair of the sustain electrodes Y and Z.

In such a discharge cell, as the phosphors 26 are light-emitted by ultraviolet rays generated upon sustain discharge, a visible ray is emitted outwardly. As a result, gray level can be implemented by adjusting the period where a discharge is sustained and a PDP whose discharge cells are arranged in a matrix shape is operated to display an image.

In the PDP according to an embodiment of the present invention, it is preferred that the alkali metal layer 20 is formed on the protection film 16. It is, however, to be understood that the alkali metal layer 20 may be formed on the upper dielectric layer 14 and the protection film 16 can be formed on the alkali metal layer 20.

The alkali metal layer 20 has its electrons easily lost since ionization energy is low and thus becomes a stable positive ion since it satisfies an octet rule. Since the alkali metal is strong in the properties that it has its electrons lost easily, it provides sufficient electrons to the discharge cell. Thus, as a low-voltage driving of the PDP is made possible, discharge efficiency is improved.

In other words, an increase in the sustain voltage that is caused by increasing the ratio of the discharge gas Xe while lowering the ratio of the discharge gas Ne in order to enhance discharge efficiency is compensated by sufficient electrons generated from the alkali metal.

Since the sustain voltage (Vs) is prevented from being increased by sufficient electrons provided by the alkali metal layer 20, a voltage margin can be secured more easily.

As the voltage margin can be secured easily by sufficient electrons provided from the alkali metal layer 20 of the present invention, the ratio of the discharge gas Xe can exceed 10%.

In addition, as shown in FIG. 2, in the case where the protection film is made of magnesium oxide (MgO), the jitter characteristic of the PDP is about 1.2 μs or more, which is relatively high. On the contrary, in the case where the alkali metal layer 20 is formed on the protection film 16, a jitter characteristic of the PDP is about 0.5 μs or less, which is relatively low. That is, the delay distance of an electron emission time point of the PDP in which the alkali metal layer 20 is formed on the protection film 16 composed of magnesium oxide (MgO) according to the present invention, is shorter than those of the conventional PDP having only the protection film composed of magnesium oxide (MgO). Accordingly, the PDP having the alkali metal layer 20 according to the present invention can be driven at high speed.

FIG. 3*a* to FIG. 3*e* are views showing a method for manufacturing an upper plate of the plasma display panel shown in FIG. 1.

Figure 3A:
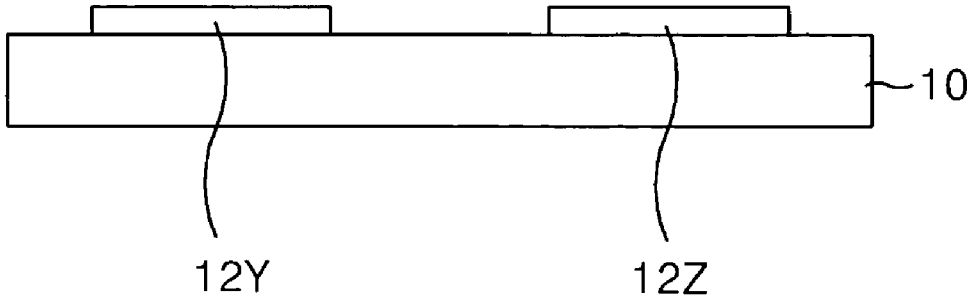
FIG. 3*a* to FIG. 3*e* are views showing a method for manufacturing an upper plate of the plasma display panel shown in FIG. 1.

Referring to FIG. 3*a*, a transparent conductive material is deposited on an upper substrate 10 and then patterned to thereby form transparent electrodes 12Y and 12Z.

Figure 3B:
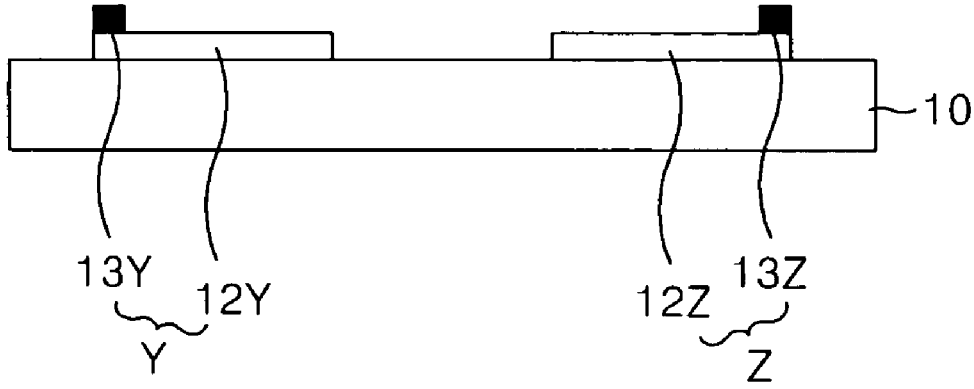

A bus electrodes material is deposited on the upper substrate 10 on which the transparent electrodes 12Y and 12Z are formed and is then patterned. Therefore, bus electrodes 13Y and 13Z are formed on the transparent electrodes 12Y and 12Z, as shown in FIG. 3*b*.

Figure 3C:
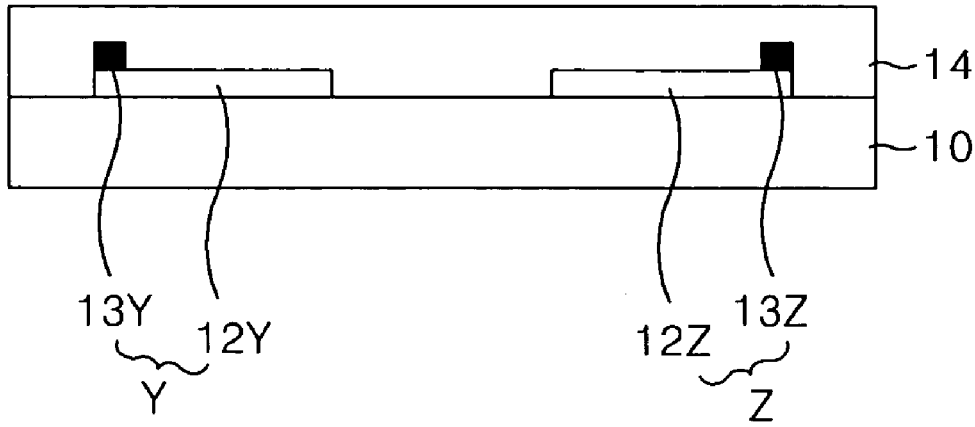

Referring to FIG. 3*c*, a dielectric layer 14 is formed on the upper substrate 10 on which the bus electrodes 13Y and 13Z are formed, by means of a screen printing method, etc.

Figure 3D:
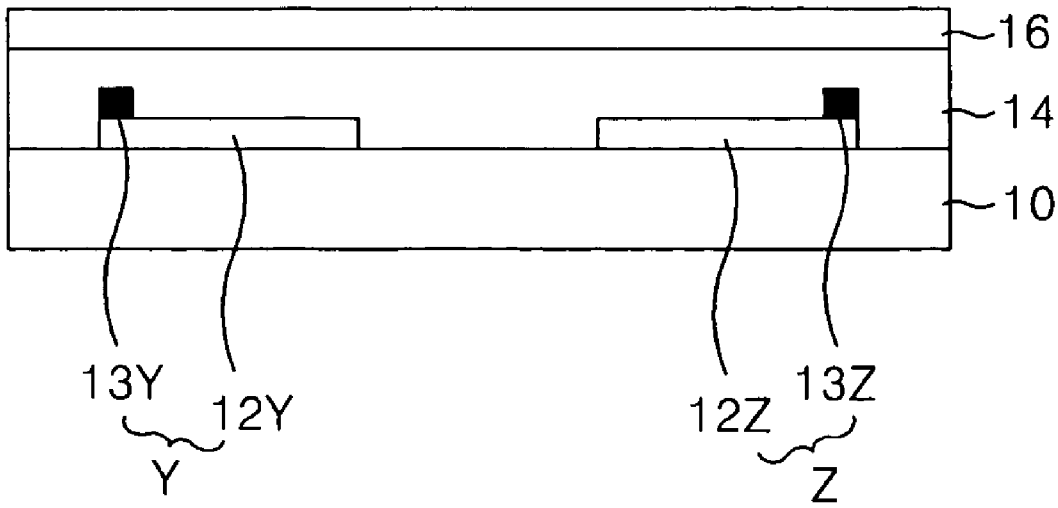

Magnesium oxide (MgO) as a material constituting a protection layer is coated on the dielectric layer 14, to thereby form a protection film 16, as shown in FIG. 3*d*.

Figure 3E:
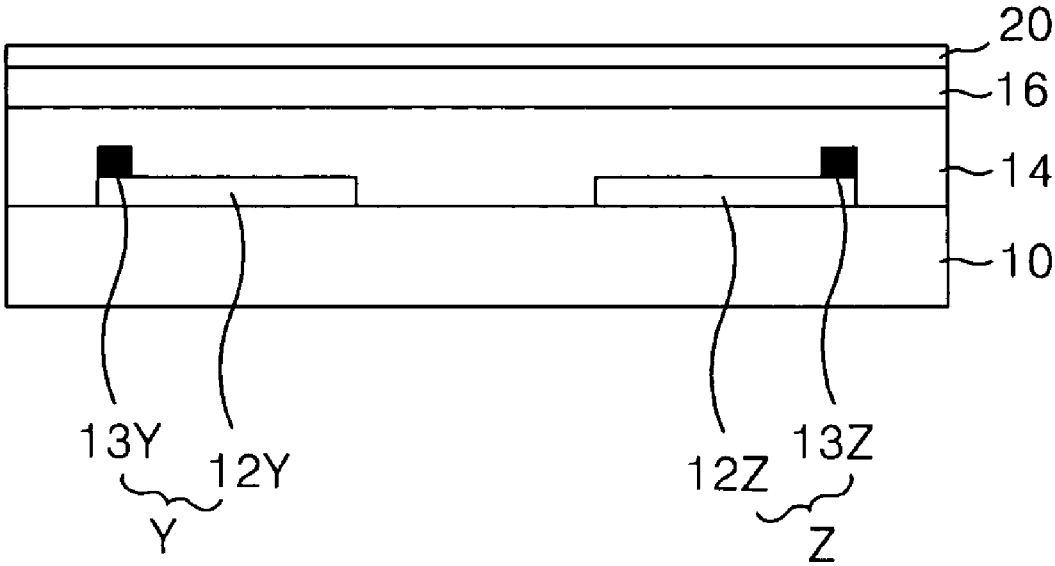

Referring to FIG. 3*e*, an alkali metal layer 20 containing an alkali metal is formed on the upper substrate 10 on which the protection film 16 are formed. In the above, examples of the alkali metal may include rubidium (Rb), potassium (K), cesium (Cs) or the like.

At this time, it is preferred that the alkali metal layer 20 is formed to a thickness of 5 Å to 1000 Å.

Second Embodiment

According to a second embodiment of the present invention, a plasma display panel including a plurality of a pair of display electrodes formed and arranged parallely on an upper plate, a plurality of address electrodes formed on a lower plate and arranged to be crossed to the display electrodes, a barrier rib defined a discharge space on the lower plate, and fluorescent body formed between the barrier ribs, wherein the plasma display panel includes further: a number of discharge cells having the discharge space; and an alkali metal layer formed in each of the discharge cells for supplying electrons to the discharge spaces, and a concentration of Xe in the discharge space is 10% or more.

Figure 4:
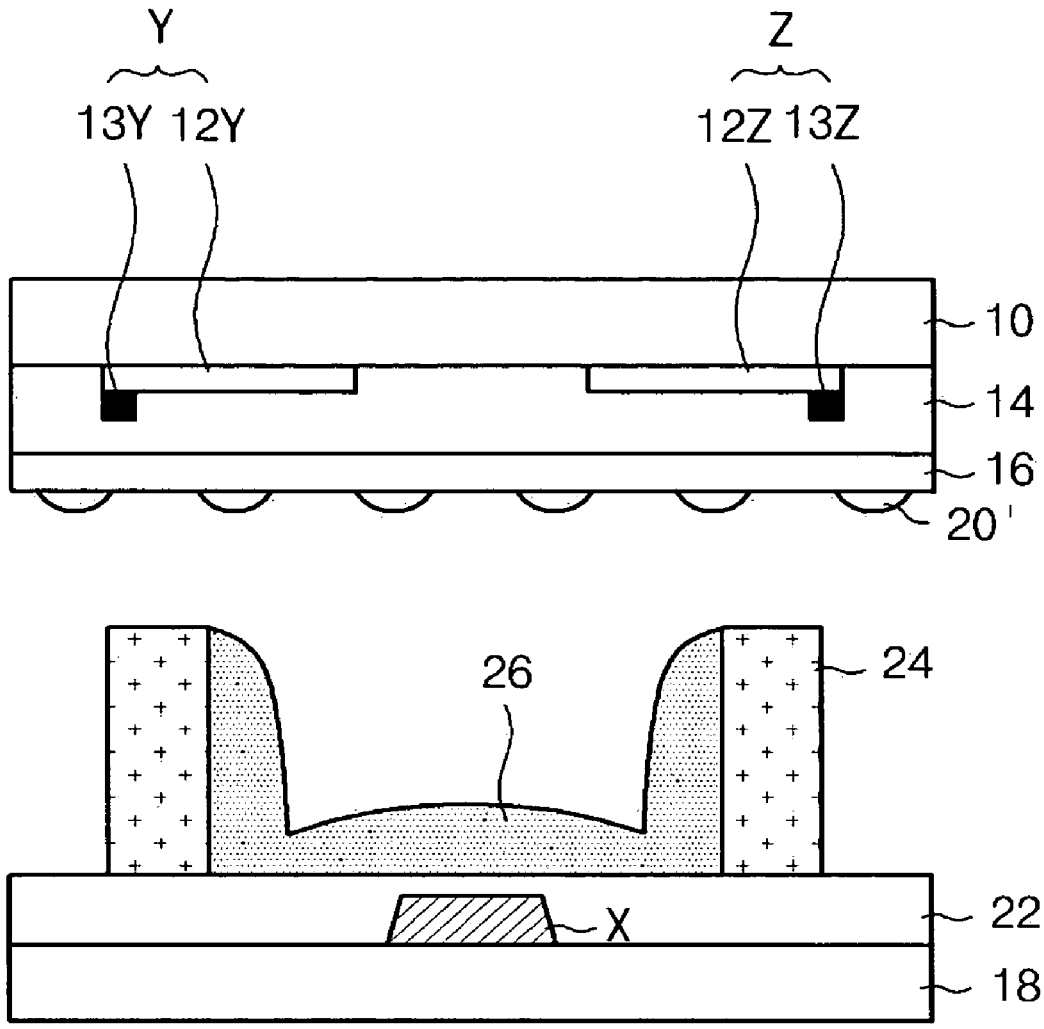
FIG. 4 is a cross-sectional view illustrating a plasma display panel according to a second embodiment of the present invention.

FIG. 4 is a cross-sectional view illustrating a plasma display panel according to a second embodiment of the present invention.

A discharge cell of the PDP shown in FIG. 4 includes a pair of sustain electrodes formed on an upper substrate 10, i.e., a scan electrode Y and a sustain electrode Z, and a data electrode X formed on a lower substrate 18.

Each of the scan electrode Y and the sustain electrode Z of the pair of the sustain electrodes has a line width smaller than that of transparent electrodes 12Y and 12Z and transparent electrodes 12Y and 12Z. The scan electrode Y and the sustain electrode Z each includes bus electrodes 13Y and 13Z, each of which is formed at the edge of one side of each of the transparent electrodes 12Y and 12Z.

An upper dielectric layer 14, a protection film 16 and alkali metal layer 20' are formed on the upper substrate 10 where the pair of the sustain electrodes Y and Z are formed. At this time, in the second embodiment of the present invention, the alkali metal layer 20' is not formed on the entire protection film 16 as in the first embodiment described above, but the alkali metal layer 20' of an embossing shape is formed on the protection film 16.

The alkali metal layer 20' having the embossing shape serves to increase emission efficiency of electrons. At this time, examples of the alkali metal may include rubidium (Rb), potassium (K), cesium (Cs) or the like.

In the PDP according to the second embodiment of the present invention, the alkali metal layer 20' is formed on the protection film 16.

The alkali metal layer 20' has its electrons easily lost since ionization energy is low and thus becomes a stable positive ion since it satisfies an octet rule. Since the alkali metal is strong in the properties that it has its electrons lost easily, it provides sufficient electrons to the discharge cell. Thus, as the PDP is driven at low voltage, discharge efficiency is improved.

In other words, an increase in the sustain voltage that is caused by relatively increasing the ratio of the discharge gas Xe while lowering the ratio of the discharge gas Ne in order to enhance discharge efficiency, is compensated by sufficient electrons generated from the alkali metal.

As the sustain voltage (Vs) is prevented from being increased by sufficient electrons provided from the alkali metal layer 20' as such, a voltage margin can be secured easily.

As the voltage margin can be secured easily by sufficient electrons provided from the alkali metal layer 20 of the present invention as such, the ratio of the discharge gas Xe can exceed 10%.

Moreover, a delay distance of an electron emission time point of the PDP in which the alkali metal layer 20' is formed on the protection film 16 composed of magnesium oxide (MgO) according to the present invention, is shorter than that of the conventional PDP having only the protection film composed of magnesium oxide (MgO). Accordingly, the PDP having the alkali metal layer 20' according to the present invention can be driven at high speed.

The alkali metal layer according to the first and second embodiments can be formed on the lower substrate.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display panel comprising:

a plurality of pairs of display electrodes formed and arranged in parallel on an upper plate, a plurality of address electrodes formed on a lower plate and arranged to be crossed to the display electrodes, a barrier rib to define a discharge space on the lower plate, a fluorescent material formed between the barrier ribs, a plurality of discharge cells having the discharge space, and a plurality of alkali metal bumps formed in the discharge cells for supplying electrons to the discharge space.

2. The plasma display panel as claimed in claim 1, wherein each of the discharge cells comprises a protection film, and the alkali metal bumps are formed on the protection film.

3. The plasma display panel as claimed in claim 2, wherein the alkali metal bumps are provided without being formed on the entire protection film.

4. The plasma display panel as claimed in claim 2, wherein the protection film comprises magnesium oxide.

5. The plasma display panel as claimed in claim 1, wherein each of the discharge cells comprises an upper dielectric layer and a protection film, and the alkali metal bumps are formed between the upper dielectric layer and the protection film.

6. The plasma display panel as claimed in claim 1, wherein each of the alkali metal bumps has a thickness of 5 Å to 1000 Å.

7. The plasma display panel as claimed in claim 1, wherein a concentration of Xe in the discharge space is 10% or more.

8. The plasma display panel as claimed in claim 1, wherein the alkali metal bumps include at least one selected from the group consisting of rubidium (Rb), potassium (K) and cesium (Cs).

9. The plasma display panel as claimed in claim 1, wherein the alkali metal bumps are formed on the lower plate.

10. A method for manufacturing a plasma display panel that includes a plurality of pairs of display electrodes formed and arranged in parallel on an upper plate, a plurality of address electrodes formed on a lower plate and arranged to be crossed to the display electrodes, a barrier rib defined a discharge space on the lower plate, and a fluorescent material formed between the barrier ribs, the method comprising:

forming a plurality of discharge cells each having the discharge space; and forming a plurality of alkali metal bumps in each of the discharge cells for supplying electrons to the discharge spaces.

11. The method as claimed in claim 10, further comprising forming a protection film in each of the discharge cells.

12. The method as claimed in claim 11, wherein forming the alkali metal bumps includes forming the alkali metal bumps without forming the alkali metal bumps on the entire protection film.

13. The method as claimed in claim 11, wherein the protection film comprises magnesium oxide.

14. The method as claimed in claim 11, wherein the alkali metal bumps are formed on the protection film.

15. The method as claimed in claim 10, further comprising forming an upper dielectric layer in each of the discharge cells, and forming a protection film, wherein the alkali metal bumps are formed between the upper dielectric layer and the protection film.

16. The method as claimed in claim 10, wherein the alkali metal bumps include at least one selected from the group consisting of rubidium (Rb), potassium (K) and cesium (Cs).

17. The method as claimed in claim 10, wherein each of the alkali metal bumps has a thickness of 5 Å to 10 Å.

18. The method as claimed in claim 10, wherein each of the alkali metal bumps is formed on the lower plate.

19. A plasma display panel comprising:

a plurality of pairs of display electrodes formed and arranged in parallel on an upper plate, a plurality of address electrodes formed on a lower plate and arranged to traverse the display electrodes, a barrier rib to define a discharge space on the lower plate, a fluorescent material formed between the barrier ribs, a plurality of discharge cells each having a corresponding discharge space, and a plurality of alkali metal bumps formed in each of the discharge cells for supplying electrons to the discharge spaces, wherein a concentration of Xe in the discharge space is 10% or more.

20. The plasma display panel as claimed in claim 19, wherein the alkali metal bumps are formed without being formed on an entire protection film.

21. The plasma display panel as claimed in claim 19, wherein each of the discharge cells comprises a protection film, and the alkali metal bumps are formed on the protection film.

22. The plasma display panel as claimed in claim 19, wherein each of the discharge cells includes an upper dielectric layer and a protection film, and the alkali metal bumps are formed between the upper dielectric layer and the protection film.

23. The plasma display panel as claimed in claim 19, wherein each of the alkali metal bumps has a thickness of 5 Å to 1000 Å.

24. The plasma display panel as claimed in claim 19, wherein the alkali metal bumps include at least one selected from the group consisting of rubidium (Rb), potassium (K) and cesium (Cs).

25. The plasma display panel as claimed in claim 19, wherein the alkali metal bumps are formed on the lower plate.

26. The plasma display panel as claimed in claim 19, wherein the protection film comprises magnesium oxide.

* * * * *